US006982413B2

(12) United States Patent
Knecht et al.

(10) Patent No.: US 6,982,413 B2
(45) Date of Patent: Jan. 3, 2006

(54) METHOD OF AUTOMATICALLY CALIBRATING ELECTRONIC CONTROLS IN A MASS SPECTROMETER

(75) Inventors: Brent A. Knecht, Lebanon, IN (US); Garth E. Patterson, Brookston, IN (US)

(73) Assignee: Griffin Analytical Technologies, Inc., West Lafayette, IN (US)

( * ) Notice: Subject to any disclaimer, the term of this patent is extended or adjusted under 35 U.S.C. 154(b) by 0 days.

(21) Appl. No.: 10/933,972

(22) Filed: Sep. 3, 2004

(65) Prior Publication Data

US 2005/0051720 A1 Mar. 10, 2005

Related U.S. Application Data

(60) Provisional application No. 60/500,545, filed on Sep. 5, 2003.

(51) Int. Cl.
*H01J 49/00* (2006.01)
*H01J 49/04* (2006.01)

(52) U.S. Cl. ..... 250/281; 250/282; 250/283; 250/299; 250/300

(58) Field of Classification Search ..... 250/281–283, 250/287, 299, 300
See application file for complete search history.

(56) References Cited

U.S. PATENT DOCUMENTS

| | | | | |
|---|---|---|---|---|
| 3,495,186 A | | 2/1970 | Wright | |
| 3,621,464 A | | 11/1971 | Bryndza | |
| 4,757,198 A | * | 7/1988 | Korte et al. | 250/288 |
| 5,579,202 A | | 11/1996 | Tolfsen et al. | |
| 5,734,163 A | | 3/1998 | Hayashi et al. | |
| 5,755,744 A | * | 5/1998 | Shaw et al. | 607/45 |
| 6,014,587 A | * | 1/2000 | Shaw et al. | 607/45 |
| 6,205,043 B1 | | 3/2001 | Chutjian et al. | |
| 6,353,324 B1 | * | 3/2002 | Uber et al. | 324/457 |
| 6,414,318 B1 | * | 7/2002 | Uber et al. | 250/389 |
| 6,434,031 B2 | | 8/2002 | Chutjian et al. | |
| 6,583,702 B2 | | 6/2003 | Chutjian et al. | |
| 2004/0183006 A1 | * | 9/2004 | Reilly et al. | 250/282 |
| 2004/0236603 A1 | * | 11/2004 | Heller et al. | 705/2 |
| 2005/0051720 A1 | * | 3/2005 | Knecht et al. | 250/288 |

* cited by examiner

*Primary Examiner*—John R. Lee
*Assistant Examiner*—Bernard E. Souw
(74) *Attorney, Agent, or Firm*—Finnegan, Henderson, Farabow, Garrett & Dunner L.L.P.

(57) ABSTRACT

The present invention provides methods and electronic circuits for a chemical analyzer, for example, a mass spectrometer, which provide generated signals that are maintained to a required level of precision. A user may specify the required precision for the signals which operate the spectrometer and may specify the required precision for the mass analysis, either explicitly or by choosing a predefined configuration. The spectrometer will then generate the signals to the required precision despite changes in operating conditions, environmental conditions, component aging and degradation, or other nonfailure effects that otherwise affect analyzer calibration and signal output. The electronic circuits incorporate signal monitoring to maintain closed-loop signal control. The closed-loop control includes a feedback path which may include discrete components and may include software enabling a processor to adjust the generated signals to maintain the required precision of the signals and analysis. Further, the spectrometer may monitor signals and analyze and store data in order to predict future performance, including precision, analysis limitations, impending component degradation or failure, or another parameter associated with a component or signal of the spectrometer. Specifically, a range for a particular parameter may be specified and a indication provided to a user when the parameter exceeds the specified range.

20 Claims, 8 Drawing Sheets

METHOD OF AUTOMATICALLY CALIBRATING ELECTRONIC CONTROLS IN A MASS SPECTROMETER

This application claims the benefit of U.S. Provisional Patent Application No. 60/500,545 filed on Sep. 5, 2003.

BACKGROUND OF THE INVENTION

1. Field of the Invention

The present invention relates generally to the field of mass spectrometers and, more specifically, to mass spectrometers that include electronic control circuits for generating and adjusting electronic signals.

2. Description of the Related Art

A particular type of mass spectrometers, an ion trap, includes electrodes for analysis and subsequent detection and measurement of ions having various mass-to-charge ratios. The components of ion traps typically include two grounded end-cap electrodes sandwiching a ring electrode to which a radio frequency (RF) signal is applied for the trapping of ions, a filament and repeller for producing an electron beam, lens elements for ion focusing in order to transport ions or electrons, and an electron multiplier, channel plate, or other ion detector. Each of these components must be supplied with a highly precise direct current (DC), RF signal, or other waveform in order to perform the steps required for mass analysis of a chemical sample.

There are many steps that are required to perform mass analysis of a sample. The sample must be acquired, transported to a mass spectrometer inlet, ionized, transported from the ionization region into the analyzer, mass analyzed, detected, digitized, and presented. Many of these steps require the precise generation of electronic signals which are also precisely biased and/or amplified to drive the above listed components of the mass spectrometer. For example, during and after ionization, the sample is manipulated with electric or magnetic fields or through fluid dynamics. The efficiency and accuracy of each of the analysis steps is dictated at least in part by the stability of the components that generate the electronic signals and resulting fields or flows. For the case of electronic field ion manipulation, the potential, frequency, and phase of signals driving the lens elements all can affect the motion of ions. Practical limitations to the electronic components used to generate the signals may cause enough inherent instability, imprecision, and degradation over time to affect the performance of the mass analysis.

Typically, the user monitors the quality of the data and modifies the generated signals of the mass spectrometer in order to maintain optimum performance. However, signal calibration before analysis and periodic monitoring of the quality of the data may not allow the required precision and stability of the signals to be maintained. Additionally, a user may not detect component degradation over time that is suggestive of an impending failure of the component.

What is needed in the art is a mass spectrometer that provides the required precision and stability of the signals. What is also needed in the art is a mass spectrometer that detects component degradation.

BRIEF SUMMARY OF THE INVENTION

The present invention provides methods and electronic circuits for a chemical analyzer, for example, a mass spectrometer, which provide generated signals that are maintained to a required level of precision. A user may specify the required precision for the signals which operate the spectrometer and may specify the required precision for the mass analysis, either explicitly or by choosing a predefined configuration. The spectrometer will then generate the signals to the required precision despite changes in operating conditions, environmental conditions, component aging and degradation, or other nonfailure effects that otherwise affect analyzer calibration and signal output.

The electronic circuits incorporate signal monitoring to maintain closed-loop signal control. The closed-loop control includes a feedback path which may include discrete components and may include software enabling a processor to adjust the generated signals to maintain the required precision of the signals and analysis. Further, the spectrometer may monitor signals and analyze and store data in order to predict future performance, including precision, analysis limitations, impending component degradation or failure, or another parameter associated with a component or signal of the spectrometer. Specifically, a range for a particular parameter may be specified and a indication provided to a user when the parameter exceeds the specified range.

The inventive electronic circuits determine the actual signals that are applied, modify the signals passively to compensate for any instability, imprecision, or other discrepancies, digitize the signals and use active compensation to further modify the signals, and collect data concerning the signals, drift in the signals, and component, circuit, or other spectrometer performance to predict future performance. The inventive spectrometer can use all of the methods of potential correction or any subset thereof. The process may operate automatically and continuously.

In one form, the present invention provides a method for controlling a signal in a mass spectrometer, including the steps of: providing a desired signal for controlling at least one of an ionization component and an analysis component of the mass spectrometer; at least one of amplifying and biasing the desired signal to produce an output signal; monitoring and storing data relating to the output signal; predicting a parameter relating to at least one of the output signal and the at least one of an ionization component and an analysis component, the predicting based on data stored in the monitoring and storing step; and providing an indication upon the parameter being outside of a range.

In another form, the present invention provides a mass spectrometer including a signal generator capable of generating a desired signal; an electronic device receiving the desired signal and capable of producing an output signal based on at least one of amplifying and biasing the desired signal; a component configured to receive the output signal; a comparator receiving the desired signal and a feedback signal, the feedback signal being dependent upon the output signal, the comparator capable of producing an error signal as a function of the desired signal and the feedback signal; and a processor receiving the error signal and having software enabling the processor to analyze the error signal and determine future performance of the component, determine impending failure of the component, and/or modify the output signal or the desired signal.

In yet another form, the present invention provides a mass spectrometer, including a component performing a mass spectrometry function; and a driving circuit electrically coupled to the component and driving the component, the driving circuit including a signal generator applying an output signal to the component; and a feedback device sensing at least one of a voltage and a current associated with the output signal and transmitting a feedback signal dependent thereon to the signal generator, wherein the signal generator modifies the output signal in order to maintain the at least one of a voltage and a current associated with the output signal within a range.

An advantage of the present invention is that the mass spectrometer includes a circuit for controlling an output signal for a component. The circuit adjusts the output signal to achieve a required precision associated with the output signal. Thus, the accuracy of the mass analysis is increased and the requirement for initial and periodic manual calibration is reduced.

Another advantage is that the mass spectrometer includes a circuit that monitors the output signal and predicts the level of precision that may be achieved and the likelihood of component or circuit degradation or impending failure of the component or circuit associated with the output signal. Thus, the reliability of the mass spectrometer may be monitored by the user.

BRIEF DESCRIPTION OF THE DRAWINGS

The above-mentioned and other features and advantages of this invention, and the manner of attaining them, will become more apparent and the invention itself will be better understood by reference to the following description of exemplary embodiments of the invention taken in conjunction with the accompanying drawings, wherein.

Corresponding reference characters indicate corresponding parts throughout the several views. The exemplifications set out herein illustrate preferred embodiments of the invention, and such exemplifications are not to be construed as limiting the scope of the invention in any manner.

DETAILED DESCRIPTION

Figure 1:
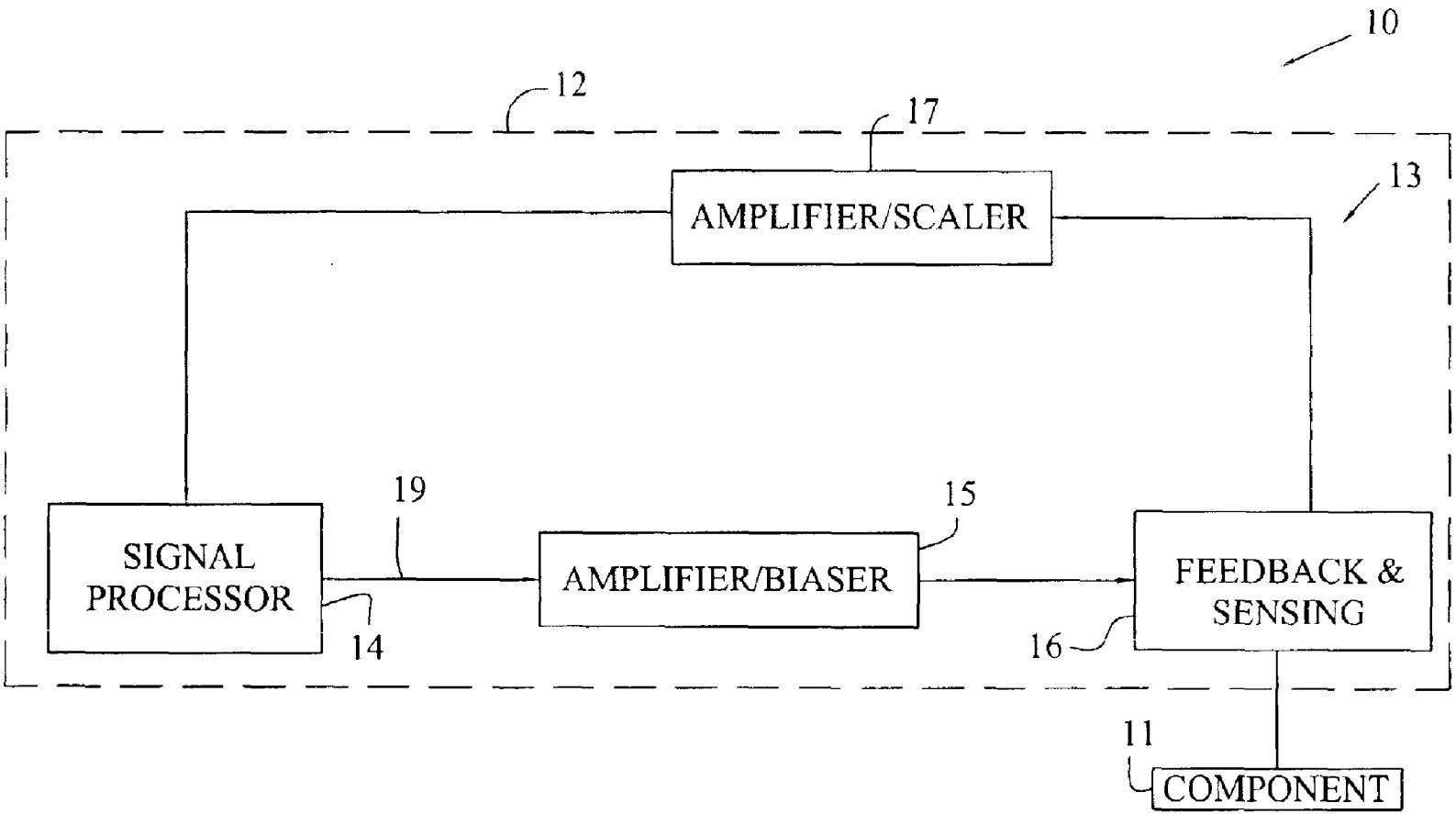
FIG. 1 is a general block diagram of a functional assembly suitable for use in a mass spectrometer of the present invention.

Referring now to the drawings, and particularly to FIG. 1, there is shown one embodiment of a functional assembly 10 suitable for use in a mass spectrometer of the present invention. Assembly 10 includes a component 11 for performing a mass spectrometry function, such as ionization, ion extraction, ion transportation, ion trapping, ion analysis, or ion detecting, for example. A driving circuit 12 is electrically coupled to and drives component 11. Driving circuit 12 may include a signal generator 13, including a signal processor 14 and an amplifier/biaser 15 for applying an output signal to component 11. A feedback and sensing device 16 senses a voltage and/or a current associated with the output signal applied to component 11. Device 16 then transmits a feedback signal dependent on the sensed voltage and/or current to signal generator 13.

The feedback signal may be amplified and/or scaled by amplifier/scaler 17 before being input to the signal processor 14. Based on the received output from amplifier/scaler 17, signal processor 14 may modify desired signal 19 such that the output signal applied to component 11, i.e., the amplified/biased version of desired signal 19, has an associated voltage and/or current within an acceptable range. That is signal generator 13 may modify the output signal in order to maintain a voltage, current, and/or other parameter associated with the output signal within a range.

Figure 2:
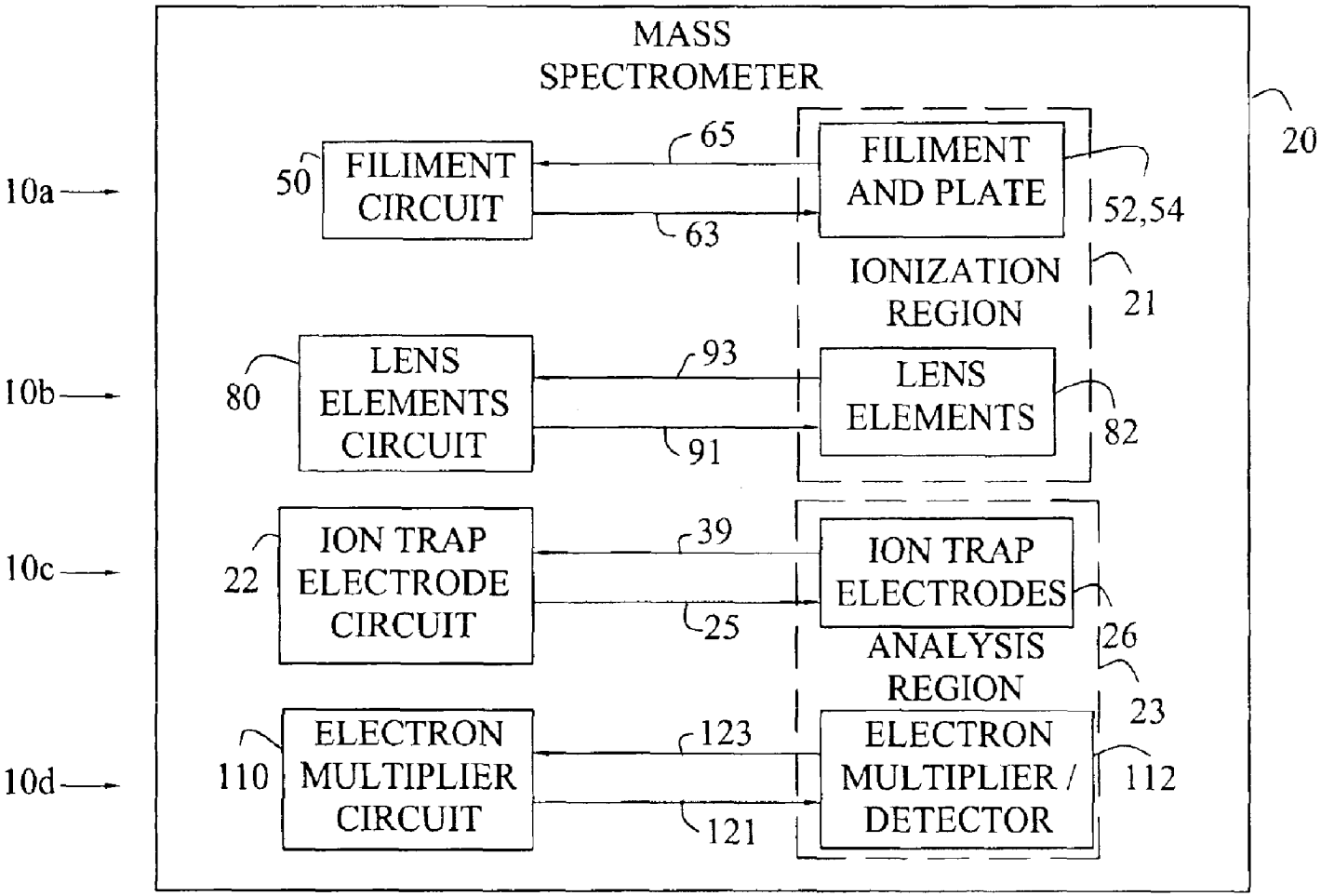
FIG. 2 is a block schematic diagram of a mass spectrometer according to the present invention including four particular embodiments of the functional assembly of FIG. 1.

Referring now to FIG. 2, exemplary mass spectrometer 20 according to the present invention may include various control circuits for driving and monitoring mass spectrometer components. More particularly, spectrometer 20 includes four functional assemblies 10*a–d* for performing respective functions of mass spectrometry. Mass spectrometer 20 includes ionization region 21 having ionization components and analysis region 23 having analysis components. Filament 52 and repeller 54 and lens elements 82 are associated with ionization region 21. Ion trap electrodes 26 and electron multiplier detector 112 are associated with analysis region 23. Ionization can, in some instances, be performed in the ion analyzer, i.e., within analysis region 23, rather than in an external volume such as ionization region 21.

Filament circuit 50 provides filament output signal 63 for driving filament 52 and repeller 54. Filament 52 and repeller 54 produce an electron beam in ionization region 21 for ionization of the sample being analyzed. Filament circuit 50 may also receive filament monitor signal 65 for monitoring and/or providing feedback related to output signal 63 and aspects of filament 52 and repeller 54.

Lens elements circuit 80 provides lens output signal 91 to lens elements 82. Lens elements 82 provide focusing of the ions generated by filament 52 and repeller 54 in order to extract and transport the ions from ionization region 21 to analysis region 23. Lens element circuit 80 may also receive lens monitor signal 93 for monitoring and/or providing feedback related to output signal 91 and aspects of lens elements 82.

Ion trap RF electrode circuit 22 provides RF electrode output signal 25 for driving ion trap electrodes 26. Electrode monitoring signal 39 may be received by electrode circuit 22 for monitoring and/or providing feedback related to output signal 25 and aspects of electrodes 26. Ion trap electrodes 26 provides RF trapping of ions in order to hold ions in place in analysis region 23.

Electron multiplier circuit 110 provides multiplier output signal 121 to electron multiplier detector 112. In addition to the feedback of signal 121, the data collected by detector 112 may be used to alter parameters of other circuits, such as the lens signals, trap RF signals, and filament voltages. Electron multiplier detector 112 detects ions which have been transported from within the volume defined by ion trap electrodes 26 to the detector 112. The ions are trapped within this volume confined by the electrodes, not on the electrodes themselves. In one embodiment (not shown), a conversion dynode is provided between ion trap electrodes 26 and detector 112. The conversion dynode may function to boost gain and allow for detection of ions of either polarity.

Electron multiplier circuit 10 may also receive multiplier monitor signal 123 for monitoring and/or providing feedback related to output signal 121 and aspects of electron multiplier detector 112.

Figure 3:
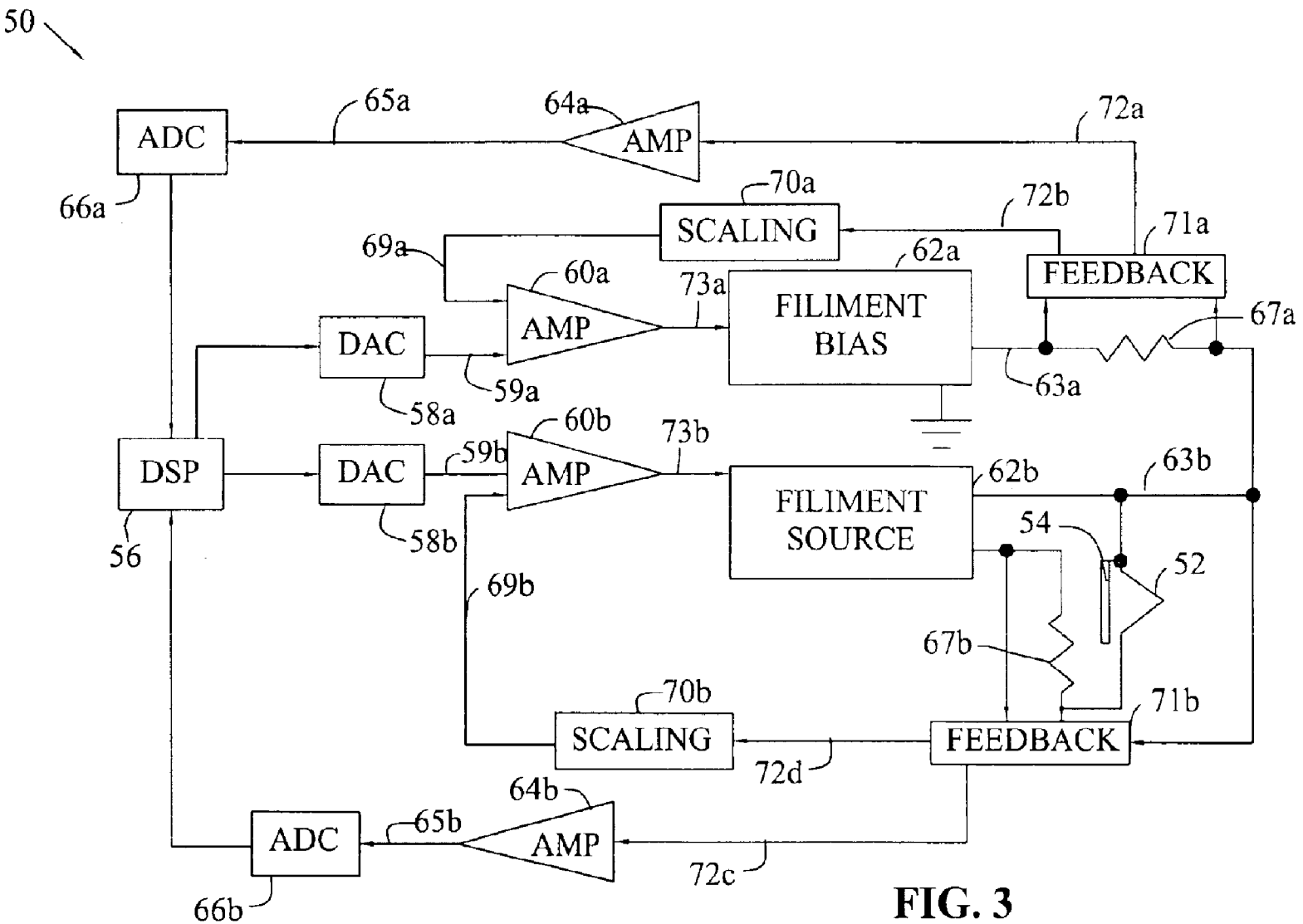
FIG. 3 is a block schematic diagram of the filament circuit of the mass spectrometer of FIG. 1.

For ion trap mass spectrometry, the sample or analyte is transferred from its native state, for example air, water, or solution, and is ionized in ionization region 21. Referring to FIG. 3, filament 52 and repeller 54, which is welded to an input end of filament 52, produce an electron beam and a particular energy electron which impact molecules of the analyte to generate ions. The ionization process can be performed by many different types of ionization that vary based on the type of sample, the mass range of the analyte, and the statistical probability of collision. The ionization types may include, for example, electron impact ionization, chemical ionization, electron capture ionization, charge exchange, or other ionization sources known in the art of mass spectrometry.

The performance and efficiency of all types of ionization relate to, at least in part, output signal 63, i.e., the combination of signals 63A and 63B, which drives filament 52 and repeller 54. The performance is also partially determined by the stability of the electronic system used to generate filament output signal 63.

In the case of electron impact ionization, the efficiency of the ionization process is determined by the accelerating potential that is imparted into the traveling electrons as well as the electron flux and ionization energy. The traveling electrons and electron flux are controlled by filament output signal 63 which is applied to repeller 54 behind discharging filament 52, and the current flow from filament 52, respectively. As the temperature of filament 52 and filament circuit 50 change, the performance also changes. Therefore, to ensure the most stable and precise mass analysis, continuous feedback regarding filament output signal 63 is desirable. Monitoring data may be used to adjust output signal 63, and to predict one or more parameters such as future performance, filament lifetime, and fault conditions. For example, as current through filament 52 changes as a result of filament degradation, the likelihood of impending failure increases, indicating a decrease in the available filament lifetime.

Referring still to FIG. 3, filament circuit 50 produces, monitors, and adjusts filament output signal 63. Digital signal processor (DSP) 56 generates digital signal information that is provided to digital-to-analog converters (DACs) 58A, 58B. From the received digital signal data, DACs 58A, 58B produce desired filament signals 59A, 59B. Amplifier buffers 60A, 60B buffer desired signals 59A, 59B and couple the signals to filament bias 62A and filament source 62B, respectively.

Filament bias 62A provides voltage level control in order to provide the required DC bias of desired filament signal 59A, thereby producing filament output signal 63A. Filament output signal 63A may be, for example, in the range of approximately 5 to 100 $\mu$Amps, while filament signal 63B may be in the range of approximately 1 to 4 Amps. Filament signal 63A provides a bias voltage for ejecting electrons from filament 52 which may be for example, from approximately −5 to −100 Volts, while filament signal 63B from filament source 62B provides power to heat filament 52. Filament output signal 63 is coupled to filament 52 and repeller 54 which produce the electron beam and particular electron energy necessary for ionization.

A current sense resistor 67B may be electrically connected in series with the bias voltage applied to filament 52. Feedback devices 71A, 71B may include voltmeters for sensing voltages associated with the output signal, such as voltages on opposite ends of resistors 67A, 67B. Moreover, from these sensed voltages, voltage drops across resistors 67A, 67B may be determined. From these voltage drops and the known resistances of resistors 67A, 67B, a level of current associated with filament 52 may be calculated. Feedback devices 71A, 71B generate feedback signals 72A–D which may be indicative of any voltage and/or current associated with the output signal applied to filament 52. In one embodiment, signal 72A is indicative of emission current, signal 72B is indicative of bias voltage, signal 72C is indicative of filament current, and signal 72D is indicative of filament voltage.

Filament output signal 63, and other output signals of mass spectrometer 20, may be monitored using all or any of three methods and associated electronic components. First, filament output signal 63 may be measured. However, for some components of spectrometer 20, the output signal is at a very high voltage and measurement may be difficult. Second, filament output signal 63 may be scaled, for example, by a voltage divider circuit, and then measured. Third, a comparison of feedback signals 72B, 72D after scaling may be made with desired signals 59A, 59B, respectively, thus providing filament error signals 73A, 73B.

The advantages of monitoring output signal 63, and other output signals of mass spectrometer 20, include controlling output signal 63 to the desired amplitude or other desired parameter, and monitoring changes in output signal 63 which are associated with changes in aspects of circuit 50 and/or filament 52 (or the component associated with the output signal of interest). Specifically, for example, as filament 52 degrades over time, changes in the current flow through filament 52 to produce a specific emission current may be reflected in a change in the voltage amplitude of output signal 63, thus requiring adjustment of output signal 63 and indicating degradation of filament 52.

The exemplary filament circuit 50 shown in FIG. 3 provides amplifier buffers 64A, 64B for receiving feedback signals 72A, 72C and producing filament monitor signals 65A, 65B. Filament monitor signals 65A, 65B may be scaled, if required, by scaling devices 70A, 70B.

Filament voltage signals 69A, 69B may be provided to amplifier buffers 60A, 60B, as shown in FIG. 3, or to filament bias 62A and filament source 62B, in order to provide passive control and adjustment of filament output signal 63, thereby providing increased precision and stability of output signal 63 based on desired filament signals 59A, 59B.

Advantageously, filament voltage signals 69A, 69B may be provided to DSP 56, which may include hardware and/or software algorithms for monitoring, analysis, and adjustment of signals and for predicting future performance. Additionally, filament current signals 65A, 65B may be received by analog-to-digital converters (ADCs) 66A, 66B, which provide digital representations of filament monitor signals 65A, 65B to DSP 56. By receiving filament current signals 65A, 65B and/or filament voltage signals 69A, 69B, DSP 56 may provide monitoring, analysis and adjustment of desired filament signals 59A, 59B in order to improve the performance and efficiency of circuit 50, filament 52 and repeller 54. Additionally, filament current signals 65A, 65B and/or filament voltage signals 69A, 69B may be monitored, analyzed and stored in order to evaluate instantaneous and trend performance and efficiency. Analysis of instantaneous and trend data allows DSP 56 to predict parameters such as the future performance of filament circuit 50, filament 52, and repeller 54, including remaining lifetime, likelihood of impending failure, or other performance information.

For example, DSP 56 may include software enabling DSP 56 to monitor, for example via output signal 63, a level corresponding with a current flow through filament 52 and to adjust output signal 63 to achieve a desired current flow though filament 52 or electron emission current off of filament 52. If the required adjustment of output signal 63 changes over time, DSP 56 may store the changes. A correlation between the stored changes over time versus the lifetime or some other parameter of filament 52 may be determined and stored by DSP 56 each time a change in output signal 63 is required, and the correlation and related information may be indicated to the user of mass spectrometer 20. Additionally, if the monitored current flow is approximately zero, the failure of filament 52 is indicated to the user.

Figure 4:
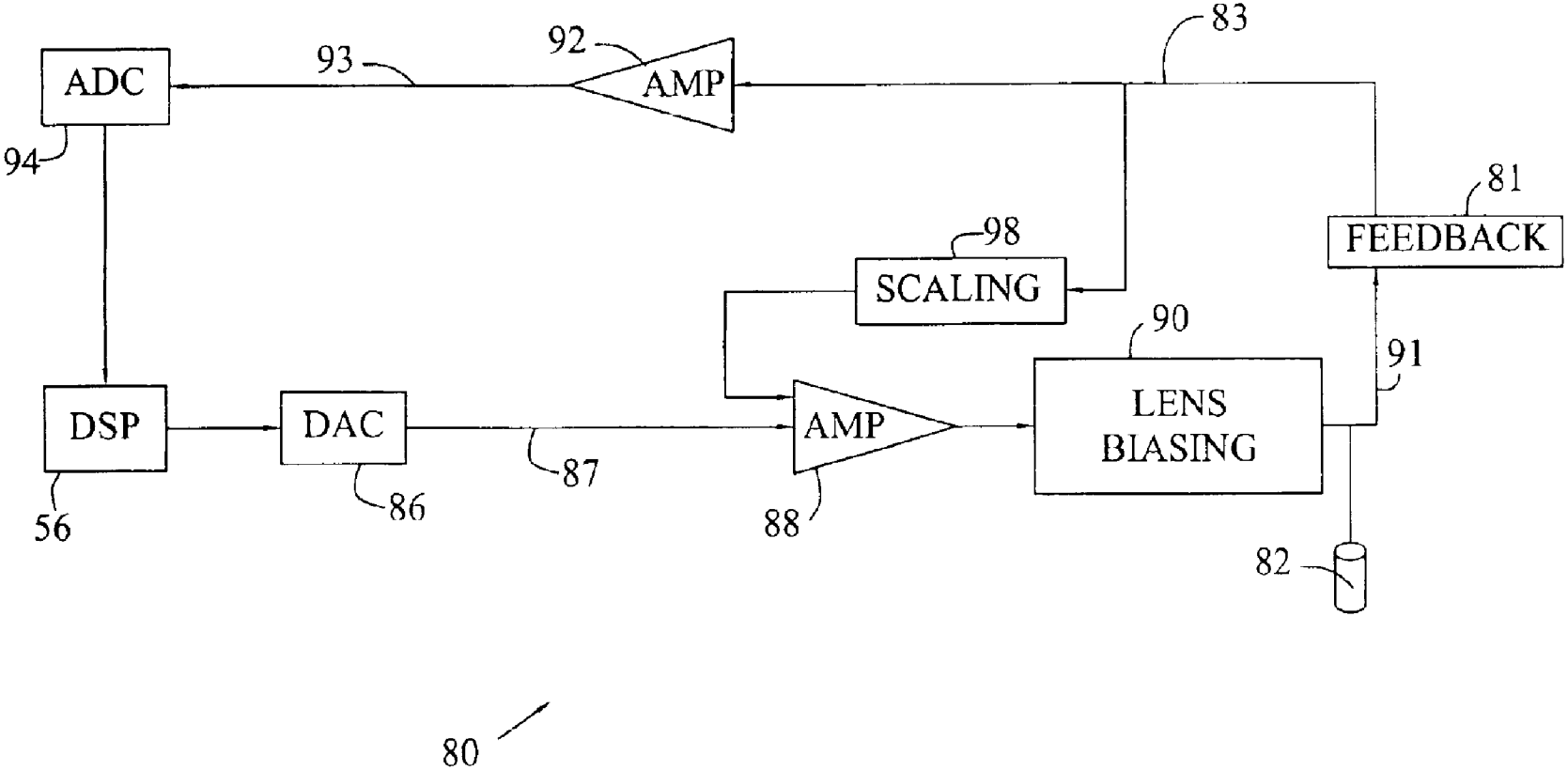
FIG. 4 is a block schematic diagram of the lens elements circuit of the mass spectrometer of FIG. 1.

Once the ions are generated, they may be extracted from ionization region 21 and transported to the analysis region 23. Alternatively, the electrons may be transported from the filament into the analysis region where they may impact the sample and generate ions. In this case, the ions are not actually being extracted. Referring to FIG. 4, in exemplary mass spectrometer 20, extraction transport is provided by lens elements 82, which may be static (typically referred to as Einzel lenses) or dynamic (typically referred to as multipole ion guides). Lens output signal 91, which is applied to lens element 82 electrodes, enables lens element 82 to focus the ions.

Output signal 91 is an important factor in the efficiency of the transfer process, as drift of output signal 91 changes the focal point of lens element 82. Additionally, for extraction and transport of ions, the bias of output signal 91 is established very accurately based on the mass of the ion, and therefore drift of output signal 91 may provide inaccurate focusing given the mass of the sample. Similarly to filament circuit 50, lens element circuit 80 produces, monitors, and adjusts lens element output signal 91 in order to increase the precision and stability of output signal 91 and improve and predict future performance and efficiency of circuit 80 and lens element 82.

Specifically, DSP 56 may provide a digital representation of the desired signal to DAC 86. DAC 86 produces desired lens element signal 87 which is coupled to an input of amplifier buffer 88. The output of amplifier buffer 88 is coupled to the input of lens element bias 90. Lens element bias 90 provides voltage level control in order to provide lens element output signal 91 in the range of, for example, −500 to 500 V DC.

Output signal 91 is coupled to lens element 82 to provide focusing of the ions for extraction and transport from the ionization region. A feedback device 81 may include a voltmeter for sensing voltages associated with the output signal, such as voltages actually present on lens element 82. Feedback device 81 generates a feedback signal 83 which may be indicative of any voltage associated with the output signal applied to lens element 82.

Feedback signal 83 is received by the input of amplifier buffer 92, which produces lens element monitor signal 93. Feedback signal 83 may be scaled, if required, by scaling device 98 and may also be provided to an input of buffer amplifier 88, as shown in FIG. 4, or to lens element bias 90 in order to adjust and increase the precision and stability of output signal 91.

Advantageously, DSP 56 may also receive a digital representation of monitor signal 93 provided by ADC 94. DSP 56 may include hardware and/or software algorithms for monitoring, analysis, and adjustment of signals and for predicting future performance. Monitor signal 93 may be monitored, analyzed, and/or stored in order to improve the precision and stability of output signal 91 and to evaluate instantaneous and trend performance. DSP 56 may thereby predict parameters such as future performance and stability of lens element circuit 80 and lens element 82.

For example, DSP 56 may include software enabling DSP 56 to monitor, for example via output signal 91, a voltage level corresponding with lens elements 82. DSP 56 may adjust output signal 91 to achieve a desired voltage level. If the required adjustment of output signal 91 changes over time, DSP 56 may store the change. A correlation between the stored change over time versus the physical structure or some other parameter of lens elements 82 may be determined and stored by DSP 56 each time a change in output signal 91 is required, and the correlation and related information may be indicated to the user of mass spectrometer 20. For example, calibration of lens elements 82 may be completed using a calibration compound of known concentration which results in data of a known peak amplitude. If the calibration peak amplitude decreases, or if the monitored voltage is outside a predefined acceptable range, the condition may be indicated to the user.

Figure 5:
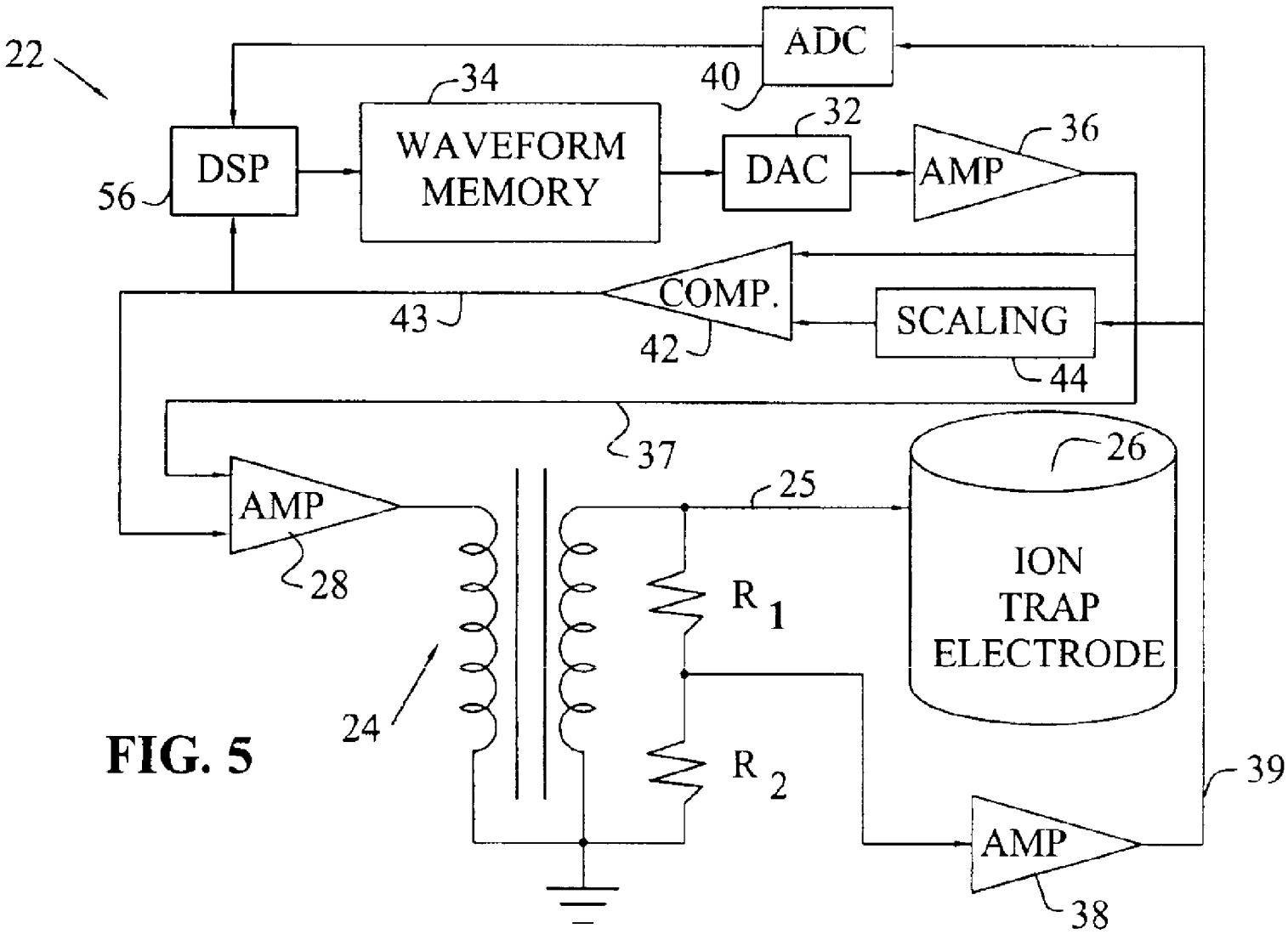
FIG. 5 is a block schematic diagram of the ion trap RF electrode circuit of the mass spectrometer of FIG. 1.

Referring to FIG. 5, while the ions are transported from the ionization region and while the ions are trapped in the analysis region, electrode output signal 25 which drives the ring electrode of ion trap electrodes 26 must also be precise and stable. Electrode output signal 25 is an amplitude modulated RF signal on the order of a peak amplitude of 3 kV, for example, and must be precise and stable in phase, amplitude, and frequency. Therefore, production, monitoring, and adjustment of output signal 25 is desirable to reduce drift associated with temperature instability, to monitor the power and efficiency of electrode circuit 22, to determine the upper mass range available in mass spectrometer 20, and to more precisely control output signal 25.

Referring still to FIG. 5, electrode RF circuit 22 generally includes a signal generation portion, power amplifier 28, power transformer 24, and circuit feedback. Transformer 24 is essentially a power supply for the ion trap electrodes 26 and provides a step-up primary-to-secondary winding ratio of approximately 100:1 in order to provide a peak amplitude of approximately 3 kV to ion trap electrodes 26. Maximum efficiency of transformer 24 is achieved by operating transformer 24 in resonance; therefore, monitoring and control of output signal 25 is critical, as lack of resonance will severely impact the gain and therefore efficiency of transformer 24 and electrode circuit 22 in general.

DSP 56 may specify and generate a digital representation of a desired signal. In the embodiment of circuit 22 shown in FIG. 5, waveform memory 34 is coupled between DSP 56 and DAC 32. DSP 56 may require the use of waveform memory 34 in order to accommodate bus speed limitations of DSP 56 and the high RF frequency of the signal output by DAC 32. Impedance amplifier buffer 36 is coupled to the output of DAC 32 and provides desired RF electrode signal 37. Desired signal 37 is provided to an input of power gain amplifier 28. The output of power gain amplifier 28 drives the primary coil of transformer 24. Advantageously, transformer 24 may be toroidally-shaped, i.e., doughnut-shaped, transformer such as that disclosed by U.S. patent application Ser. No. 60/500,398, entitled "Portable Mass Spectrometer Having Radio Frequency Amplifier Circuitry of Reduced Size," filed on Sep. 5, 2003, by Knecht et al., the assignee of which is the assignee of the present application, the disclosure of which is hereby incorporated by reference herein.

In order to monitor the extremely high voltage of output signal 25, a voltage dividing network including, for example, series resistor R1 and sense resistor R2, may be provided. Sense resistor R2 has a resistance value much smaller than that of series resistor R1 so that amplifier buffer 38, the input of which is coupled to the node between resistors R1 and R2, receives a more manageable voltage which is proportional to the voltage of output signal 25. Alternatively, the voltage dividing network may be capacitive, or another voltage scaling device known in the art may be utilized.

The output of amplifier buffer 38 provides RF electrode monitor signal 39. Monitor signal 39, or a scaled version thereof provided by scaling device 44, may be coupled to an input of comparator 42 which also receives desired signal 37 and produces RF electrode error signal 43 as a difference between the two input signals. In order to increase the precision and stability of output signal 25, error signal 43 may be coupled to an input of power gain amplifier 28.

Advantageously, DSP 56 may also receive one or both of error signal 43 and a digital representation of monitor signal 39 which is provided by ADC 40. DSP 56 may include hardware and/or software algorithms for monitoring, analysis, and adjustment of signals and for predicting future performance. One or both of error signal 43 and monitor signal 39 may be monitored, analyzed, and stored in order to adjust desired signal 37 and improve the performance and stability of output signal 25, for example, by adjusting desired signal 37 so that transformer 24 is efficiently operating in resonance. Additionally, one or both of error signal 43 and monitor signal 39 may be monitored, analyzed, and stored by DSP 56 in order to evaluate instantaneous and trend performance and thereby predict future performance of circuit 22 and electrodes 26. For example, DSP 56 may determine component life of electrodes 26, the mass range of mass spectrometer 20, or other performance, degradation, or impending component failure. Incidentally, the component life of electrodes 26 may be the time period before the electrodes need to be cleaned. After cleaning, the electrodes may be returned to service.

DSP 56 may include software enabling DSP 56 to monitor, for example via output signal 39, a level corresponding with the amplitude modulated voltage applied to electrodes 26 versus a desired amplitude and to adjust output signal 25 to achieve the desired amplitude. If the required adjustment of output signal 25 changes over time, for example, over a period of one hour, DSP 56 may store the change. A correlation between the stored changes over time versus a temperature of circuit 22, for example the temperature of amplifier 28 or some other environmental condition in circuit 22, may be determined and stored by DSP 56 each time a change in output signal 25 is required, and the correlation and related information, for example the available mass range of mass spectrometer 20 or a possible temperature failure of amplifier 28 based on the relationship between the amplitude of output signal 25 and the temperature of amplifier 28, may be indicated to the user of mass spectrometer 20. Additionally, if the monitored amplitude is outside a predetermined range, the occurrence may be indicated to the user.

Figure 6:
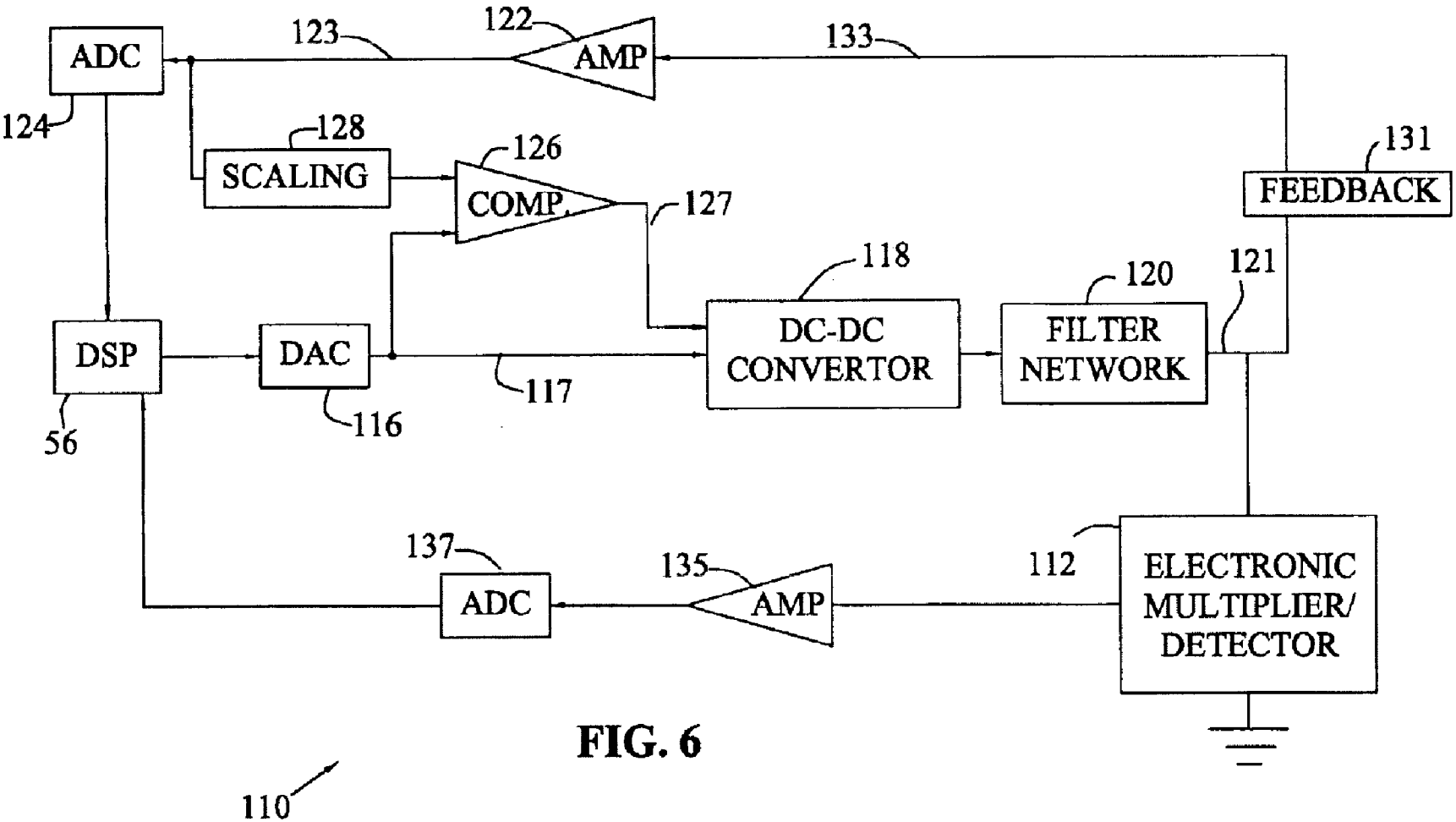
FIG. 6 is a block schematic diagram of the electron multiplier circuit of the mass spectrometer of FIG. 1.

After analysis, ions are detected using one of a variety of types of detectors known in the art, for example, electron multiplier detector 112 shown in FIG. 6, and may be preceded after ejection by a conversion dynode. Electron multiplier detector 112 converts the low ion current of multiplier output signal 121 into a higher current using an electron cascading event. For example, electron multiplier detector 112 may be of high impedance providing current gain on the order of six orders of magnitude. The gain of electron multiplier detector 112 is related to the applied voltage of output signal 121 relative to a current detection electrode (not shown). Therefore, a small variance in output signal 121, which is applied to the entrance or input of electron multiplier detector 112, results in a very high gain and hence a change in response or baseline noise.

High frequency noise may result in a spurious signal that appears as though it were related to the presence of a chemical, whereas low frequency noise may appear as though it were a change in baseline noise or a change in the static gain of the detector. Therefore, electron multiplier circuit 110 includes filter network 120 for reducing noise present in output signal 121 and also includes circuitry for monitoring and control of output signal 121. Electron multiplier detector 112 also decreases in gain as the multiplier ages, thus requiring adjustment of output signal 121 in order to provide the same gain. Therefore, by monitoring the adjustment in the applied potential of output signal 121 to electron multiplier detector 112, the remaining lifetime of electron multiplier detector 112 may be predicted.

Digital signal processor 56 may provide a digital representation of a desired signal to DAC 116. The output of DAC 116 produces desired electron multiplier signal 117 which is coupled to an input of DC-to-DC converter 118. DC-to-DC converter 118 may be, for example, a step-up converter that provides DC amplification. The output of DC-to-DC converter 118 is provided to the input of filter network 120, which may be, for example, an RC filter to reduce noise of the provided output signal 121. Output signal 121 may be, for example, on the order of approximately −1 to −3 kV. Output signal 121 may be turned on and off during the time of one analytical scan.

A feedback device 131 may include a voltmeter for sensing voltages associated with the output signal, such as voltages applied to detector 112. Feedback device 131 generates a feedback signal 133 which may be indicative of any voltage associated with the output signal applied to electron multiplier detector 112.

Feedback signal 133 is received by the input of amplifier buffer 122 which receives feedback signal 133 and provides electron multiplier monitor signal 123. Monitor signal 123, or a scaled version thereof provided by scaling device 128, may be provided to an input of DC comparator 126. DC comparator 126, which may be included in circuit 110, compares monitor signal 123 with desired signal 117 and outputs electron multiplier error signal 127. Error signal 127 may be provided to an input to DC-to-DC converter 118, thereby adjusting output signal 121 in order to provide greater precision and stability.

Advantageously, one or both of error signal 127 and a digital representation of monitor signal 123 provided by ADC 124 may be received by DSP 56. DSP 56 may include hardware and/or software algorithms for monitoring, analysis, and adjustment of signals and for predicting future performance. One or both of error signal 127 and monitor signal 123 may be monitored, analyzed, and stored by DSP 56 in order to adjust desired signal 117, thereby increasing the performance and stability of output signal 121. Additionally, DSP 56 may monitor, analyze, and store one or both of error signal 127 and monitor signal 123 in order to evaluate instantaneous and trend performance and thereby predict parameters such as future performance, degradation, lifetime, and/or impending failure of electron multiplier detector 112, output signal 121, and circuit 110.

For example, DSP 56 may include software enabling DSP 56 to monitor, for example via output signal 121, a DC voltage level applied to electron multiplier detector 112 and to adjust output signal 121 to achieve a desired voltage level applied to electron multiplier detector 112. If the required adjustment of output signal 121 changes over time, DSP 56 may store the changes. A correlation between the stored changes over time versus an average baseline DC level for mass spectrometry data acquired (which is associated with the available gain of electron multiplier detector 112, which may decline over time) or some other parameter of electron multiplier detector 112 may be determined and stored by DSP 56. The stored decline over time may be associated with the lifetime of electron multiplier detector 112. If the average baseline DC level decreases outside a specified range, then DSP 114 may adjust the DC voltage level for output signal 121 accordingly. Each time a change in output signal 121 is required the correlation and related information may be indicated to the user of mass spectrometer 20. Additionally, if the monitored DC voltage level has a magnitude greater than approximately −3 kV, or if output signal 121 can not be adjusted to a predetermined range the failure of electron multiplier detector 112 may be indicated to the user.

The output of detector 112, i.e., spectrometer data, may be received by the input of amplifier buffer 135. Advantageously, DSP 56 may receive a digital representation of the output of buffer 135 as provided by ADC 137. DSP 56 may include hardware and/or software algorithms for analyzing the digital spectrometer data from ADC 137. DSP 56 may then adjust hardware or signals within any of circuits 50, 80, 22 and 110 based upon the analysis of the digital spectrometer data.

Figure 7:
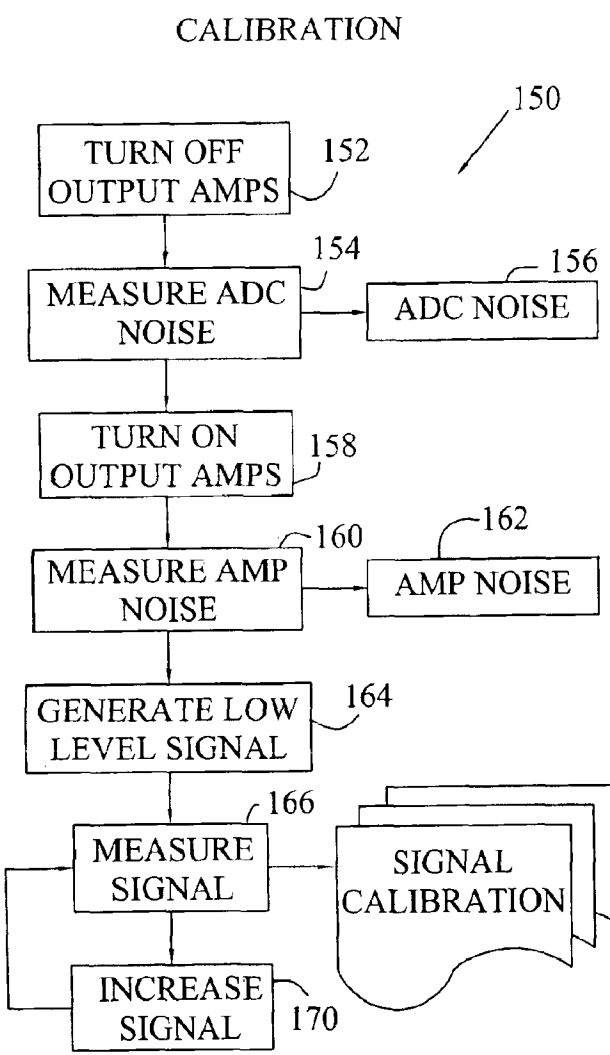
FIG. 7 is a flow diagram representing a method of calibrating the mass spectrometer of FIG. 1.

Referring to FIG. 7, method 150 illustrates the steps of an exemplary calibration of any one of circuits 22, 50, 80, and 110 of mass spectrometer 20. For purposes of illustration, method 150 will be discussed relative to calibration of RF electrode circuit 22; however, method 150 may also be associated with circuits 50, 80, and 110.

In step 152, DSP 56, or another processor or control element of circuit 22, turns off the output of amplifiers 28, 36 and 38. In step 154, digital signal processor 56 measures and stores in data block 156 the noise received from ADC 40. In step 158, DSP 56 turns on the outputs of amplifiers 28, 36 and 38. Alternatively, the output of amplifier 38 may be turned on shortly after the outputs of amplifiers 28 and 36 have been turned on. In step 160, DSP 56 measures and stores to data block 162 the noise produced by amplifiers 28, 36, and 38. In step 164, DSP 56 generates a low level signal. In step 166, DSP 56 measures the sample signal and stores in data blocks 168 a signal calibration that is a function of the generated and measured signals, including the noise stored in data blocks 156 and 162. In step 170, digital signal processor 56 increases the sample signal level and repeats step 166 as required until a full signal range for DSP 56 has been measured and calibrated.

Figure 8:
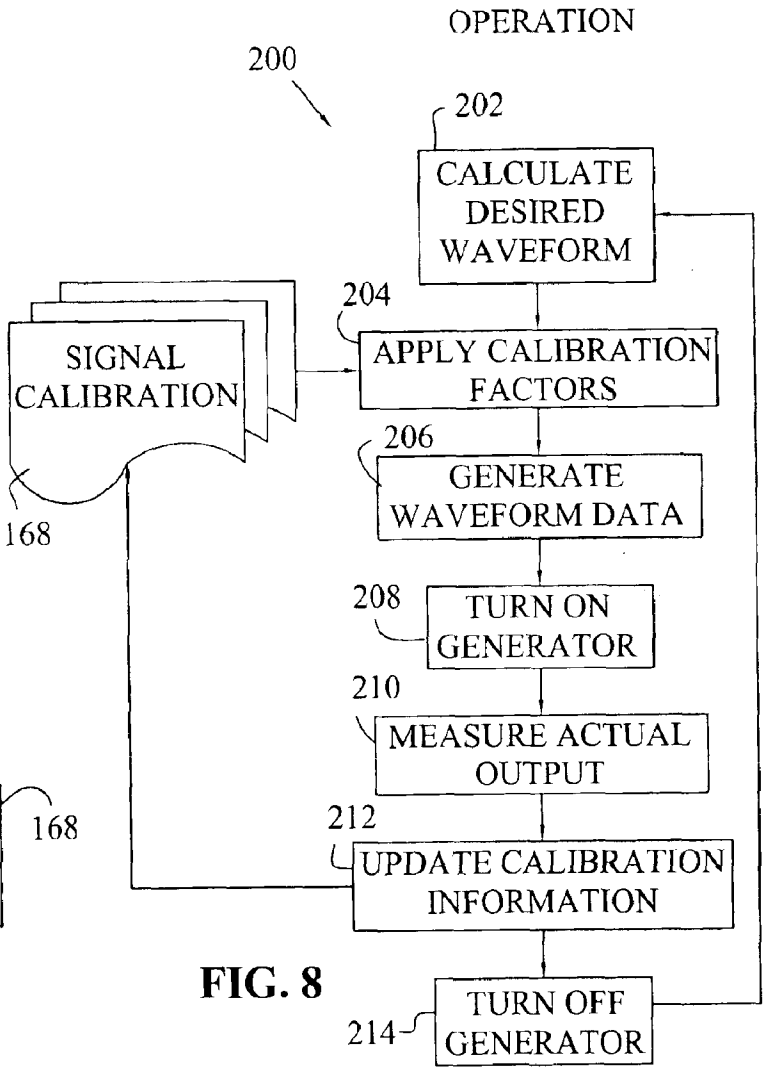
FIG. 8 is a flow diagram illustrating a first exemplary operating method associated with the mass spectrometer of FIG. 1.

Referring to FIG. 8, method 200 provides an illustration of exemplary steps for operating any of circuits 22, 50, 80, and 110. In order to further illustrate method 200, the steps of method 200 will be discussed relative to ion trap electrode circuit 22; however, method 200 may be applied similarly to circuits 50, 80, and 110.

In step 202, DSP 56 calculates a desired signal waveform which has been specified by a user or otherwise provided. In step 204, DSP 56 applies signal calibration factors, such as those stored in data blocks 168 of method 150. In step 206, DSP 56 generates waveform data for the desired signal. In step 208, power gain amplifier 28 and/or other elements of the signal generation circuit, for example, DAC 32, are turned on by DSP 56, or another processor or control element. In step 210, DSP 56 measures at least one of output signal 25, monitor signal 39, and error signal 43. In step 212, DSP 56 adjusts signal calibration data stored in data blocks 168 based on the measurements of step 210. In step 214, if the desired signal is complete, method 200 continues at step 202, else power gain amplifier 28 and/or other elements of the signal generation circuit are turned off, for example, DAC 32.

Figure 9:
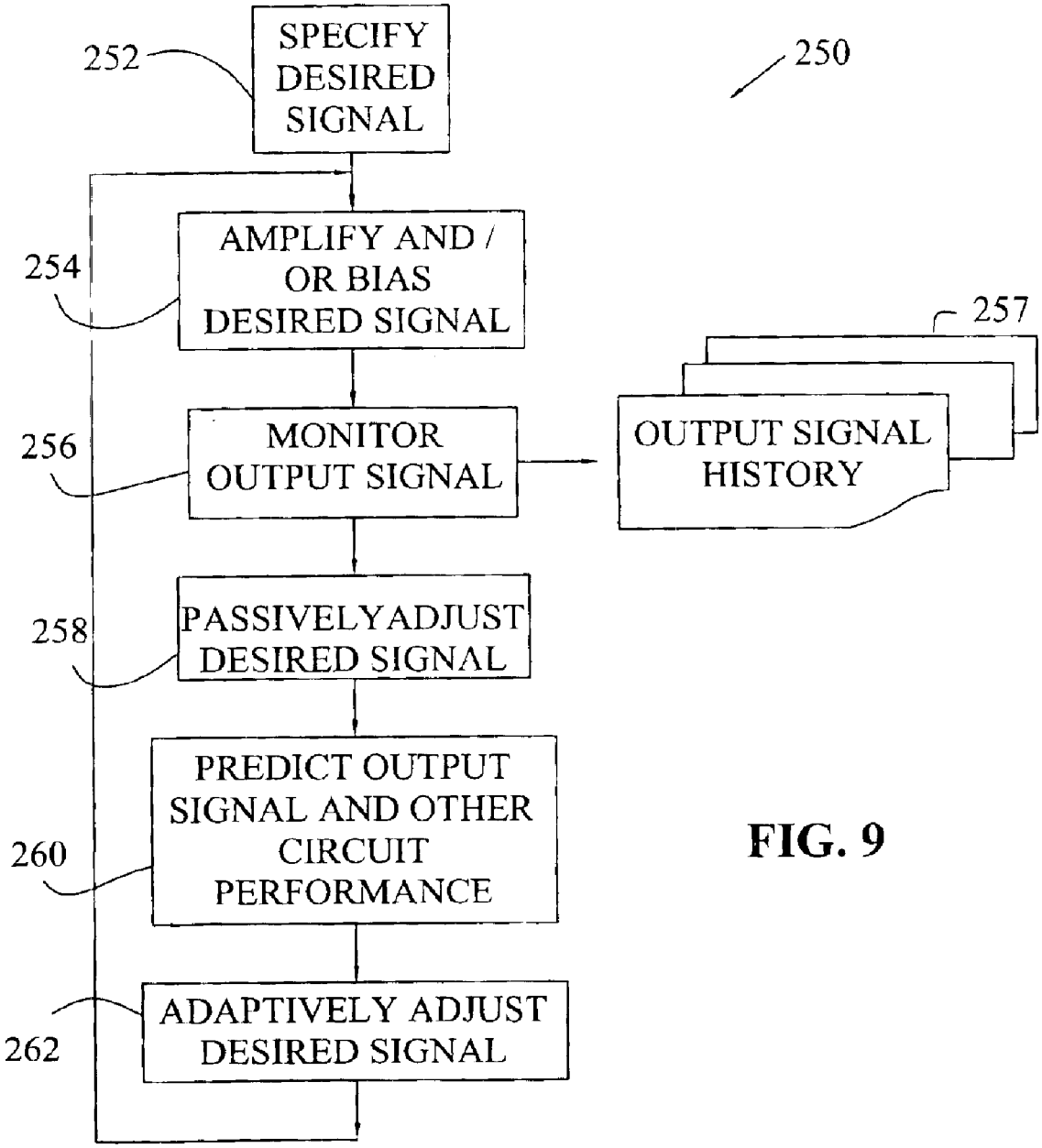
FIG. 9 is a flow diagram illustrating a second exemplary operating method associated with the mass spectrometer of FIG. 1.

Referring to FIG. 9, a second exemplary method 250 for operating and controlling any of circuits 22, 50, 80, and 110 is illustrated. For purposes of further illustrating method 250, the steps of method 250 will be discussed relative to RF electrode circuit 22; however, method 250 may be similarly applied to circuits 50, 80, and 110.

In step 252, a desired signal is specified or otherwise associated with DSP 56. For example, a user may specify the desired signal, or select a desired signal based on a pre-established configuration or other set-up. In step 254, power gain amplifier 28 and transformer 24 at least one of amplifies and biases desired signal 37, providing output signal 25. In step 256, DSP 56 monitors and stores in data blocks 257 output signal 25, for example, by receiving at least one of monitor signal 39 and error signal 43. In step 258, if included with circuit 22, comparator 42 compares monitor signal 39 to desired signal 37 to produce error signal 43. Error signal 43 is received by power gain amplifier 28, in order to adjust desired signal 37 and increase the precision of output signal 25. Alternatively, if comparator 42 is not included in circuit 22, DSP 56 may adjust desired signal 37 based upon monitor signal 39. In step 260, DSP 56 predicts output 25 and other circuit performance, such as the efficiency of ring electrode 26, degradation, lifetime, impending failure, or other aspects of ion trap 26 and circuit 22, for example, as discussed above for circuits 50, 80, 22 and 110. Specifically, DSP 56 may predict such aspects by analysis of output signal history stored in data blocks 257. Based on predicted aspects of ring electrode 26 and circuit 22, in step 262 DSP 56 adaptively adjusts desired signal 37 to increase precision and stability of output signal 25, for example, as discussed above for circuits 50, 80, 22 and 110. Alternatively, or additionally, an indication may be provided that a parameter is outside of a predetermined acceptable range. After step 262, method 250 continues at step 254 as long as specified desired signal 252 continues. Thus, steps 252 through 262 may be repeated continually and/or continuously.

Circuits 50, 80, 22 and 110 have been described above as including a common DSP 56. However, it is to be understood that each of circuits 50, 80, 22 and 110 may have its own dedicated DSP. Moreover, it is possible within the scope of the present invention for DSP 56 to be replaced with a different type of processor.

While this invention has been described as having exemplary embodiments, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for controlling a signal in a mass spectrometer, comprising the steps of:

providing a desired signal for controlling at least one of an ionization component and an analysis component of the mass spectrometer;

at least one of amplifying and biasing the desired signal to produce an output signal;

monitoring and storing data relating to the output signal;

predicting a parameter relating to at least one of the output signal and the at least one of an ionization component and an analysis component, the predicting based on data stored in the monitoring and storing step; and providing an indication upon the parameter being outside of a range.

2. The method of claim 1, further comprising the step of passively adjusting at least one of the output signal and the desired signal based on the data of said monitoring and storing step.

3. The method of claim 1, further comprising the step of adaptively adjusting at least one of the output signal and the desired signal based on said monitoring and storing data step.

4. The method of claim 3, wherein said above steps are repeated at least one of continually and continuously.

5. A mass spectrometer, comprising:

a signal generator capable of generating a desired signal;

an electronic device receiving said desired signal and capable of producing an output signal based on at least one of amplifying and biasing said desired signal;

a component configured to receive said output signal;

a comparator receiving said desired signal and a feedback signal, said feedback signal being dependent upon said output signal, said comparator capable of producing an error signal as a function of said desired signal and said feedback signal; and a processor receiving said error signal and having software enabling said processor to analyze said error signal and at least one of:

determine future performance of said component;

determine impending failure of said component; and modify one of the output signal and the desired signal.

6. The mass spectrometer of claim 5, wherein said signal generator includes said processor.

7. The mass spectrometer of claim 6, wherein said component includes a filament and repeller and said electronic device provides biasing of said output signal.

8. The mass spectrometer of claim 6, wherein said component includes a lens element and said electronic device provides biasing of said output signal.

9. The mass spectrometer of claim 6, wherein said component includes an ion trap electrode and said electronic device includes an amplifier and transformer for amplifying said output signal.

10. The mass spectrometer of claim 6, wherein said component includes an electron multiplier and said electronic device includes a DC—DC converter for amplifying said output signal.

11. The mass spectrometer of claim 6, wherein said processor includes software enabling said processor to control and modify at least one of said desired signal and said output signal based on said error signal.

12. A mass spectrometer, comprising:

a component configured to perform a mass spectrometry function; and a driving circuit electrically coupled to said component and configured to drive said component, said driving circuit including:

a signal generator configured to apply an output signal to said component; and a feedback device configured to sense at least one of a voltage and a current associated with the output signal and transmit a feedback signal dependent thereon to said signal generator, wherein said signal generator is configured to modify the output signal in order to maintain said at least one of a voltage and a current associated with the output signal within a range.

13. The mass spectrometer of claim 12, wherein said component includes a filament and repeller and said signal generator includes a signal biasing device.

14. The mass spectrometer of claim 12, wherein said component includes a lens element and said signal generator includes a signal biasing device.

15. The mass spectrometer of claim 12, wherein said component includes an ion trap electrode and said signal generator includes an amplifier and transformer.

16. The mass spectrometer of claim 12, wherein said component includes an electron multiplier and said signal generator includes a DC—DC converter.

17. The mass spectrometer of claim 12, wherein said signal generator includes software enabling said signal generator to analyze at least one of the feedback signal and a difference between said feedback signal and a desired signal and to determine therefrom at least one of future performance and impending failure of said component.

18. The mass spectrometer of claim 12, wherein said signal generator includes a digital signal processor.

19. The mass spectrometer of claim 12, wherein said signal generator generates a desired signal and includes a comparator receiving said desired signal and said feedback signal, said comparator producing an error signal as a function of said desired signal and said feedback signal.

20. The mass spectrometer of claim 12, wherein said feedback device includes a current sense resistor enabling said feedback device to sense a current associated with the output signal.

* * * * *

UNITED STATES PATENT AND TRADEMARK OFFICE

CERTIFICATE OF CORRECTION

PATENT NO. : 6,982,413 B2
DATED : January 3, 2006
INVENTOR(S) : Brent A. Knecht et al.

It is certified that error appears in the above-identified patent and that said Letters Patent is hereby corrected as shown below:

Drawings,

Figure 2, figure number 50, "FILIMENT CIRCUIT" should read -- FILAMENT CIRCUIT --.

Figure 2, figure number 32, "FILIMENT AND PLATE" should read -- FILAMENT AND PLATE --.

Figure 3, figure number 62a "FILIMENT BIAS" should read -- FILAMENT BIAS --.

Figure 3, figure number 62b, "FILIMENT SOURCE" should read -- FILAMENT SOURCE --.

Signed and Sealed this

Eighteenth Day of April, 2006

JON W. DUDAS
*Director of the United States Patent and Trademark Office*